US009260941B2

(12) United States Patent
Linklater

(10) Patent No.: US 9,260,941 B2
(45) Date of Patent: Feb. 16, 2016

(54) DOWNHOLE TOOL AND METHOD

(75) Inventor: James Linklater, Banffshire (GB)

(73) Assignee: M-I Drilling Fluids UK Limited, Aberdeen (GB)

( * ) Notice: Subject to any disclaimer, the term of this patent is extended or adjusted under 35 U.S.C. 154(b) by 576 days.

(21) Appl. No.: 13/575,895

(22) PCT Filed: Feb. 4, 2011

(86) PCT No.: PCT/GB2011/050191

§ 371 (c)(1),
(2), (4) Date: Sep. 6, 2012

(87) PCT Pub. No.: WO2011/095816

PCT Pub. Date: Aug. 11, 2011

(65) Prior Publication Data

US 2013/0000884 A1 Jan. 3, 2013

(30) Foreign Application Priority Data

Feb. 5, 2010 (GB) ..... 1001917.2

(51) Int. Cl.
*E21B 31/06* (2006.01)
*E21B 37/00* (2006.01)

(52) U.S. Cl.
CPC ..... *E21B 37/00* (2013.01); *E21B 31/06* (2013.01)

(58) Field of Classification Search
CPC ..... E21B 31/06; E21B 37/00
USPC ..... 166/311, 99, 301, 242.1, 66.5, 173
See application file for complete search history.

(56) References Cited

U.S. PATENT DOCUMENTS

| | | | | |
|---|---|---|---|---|
| 3,637,033 | A | 1/1972 | Mayall | |
| 6,354,386 | B1 | 3/2002 | Ruttley | |
| 6,439,303 | B1 | 8/2002 | Sorhus et al. | |
| 6,591,117 | B1 | 7/2003 | Kim | |
| 6,655,462 | B1 * | 12/2003 | Carmichael et al. | 166/311 |
| 6,841,996 | B2 | 1/2005 | Madio et al. | |
| 2005/0274524 | A1 * | 12/2005 | Silguero | 166/311 |
| 2006/0011346 | A1 * | 1/2006 | Theriot, Sr. | 166/311 |
| 2008/0264624 | A1 | 10/2008 | Hall et al. | |
| 2009/0128144 | A1 | 5/2009 | Freedman et al. | |
| 2009/0211816 | A1 | 8/2009 | Williams | |

FOREIGN PATENT DOCUMENTS

| | | | |
|---|---|---|---|
| CN | 101205804 | A | 6/2008 |
| DE | 35 43 295 | A1 | 6/1987 |
| GB | 2 350 632 | A | 12/2000 |
| GB | 2 364 539 | A | 1/2002 |
| WO | 2010/007434 | A2 | 1/2010 |

OTHER PUBLICATIONS

International Search Report from PCT/GB2011/050191 dated Jan. 9, 2012 (3 pages).

(Continued)

*Primary Examiner* — Robert E Fuller
*Assistant Examiner* — Dave Carroll

(57) ABSTRACT

A cleaning tool (1) for use in cleaning ferrous material from a wellbore has a magnetic cleaning functionality by provision of magnets (5) in an Halbach array on a downhole tool component of a workstring. The Halbach array may be an Halbach cylinder positioned on a mandrel wherein the magnetic field is external to the cylinder with substantially zero magnetic field within the tool.

10 Claims, 5 Drawing Sheets

(56) References Cited

OTHER PUBLICATIONS

Written Opinion from PCT/GB2011/050191 dated Jan. 9, 2012 (7 pages).

Examination Report issued in GB1214467.1 on Feb. 27, 2015, 2 pages.

International Preliminary Report on Patentability issued in GB1214467.1 on Feb. 27, 2015, 7 pages.

* cited by examiner

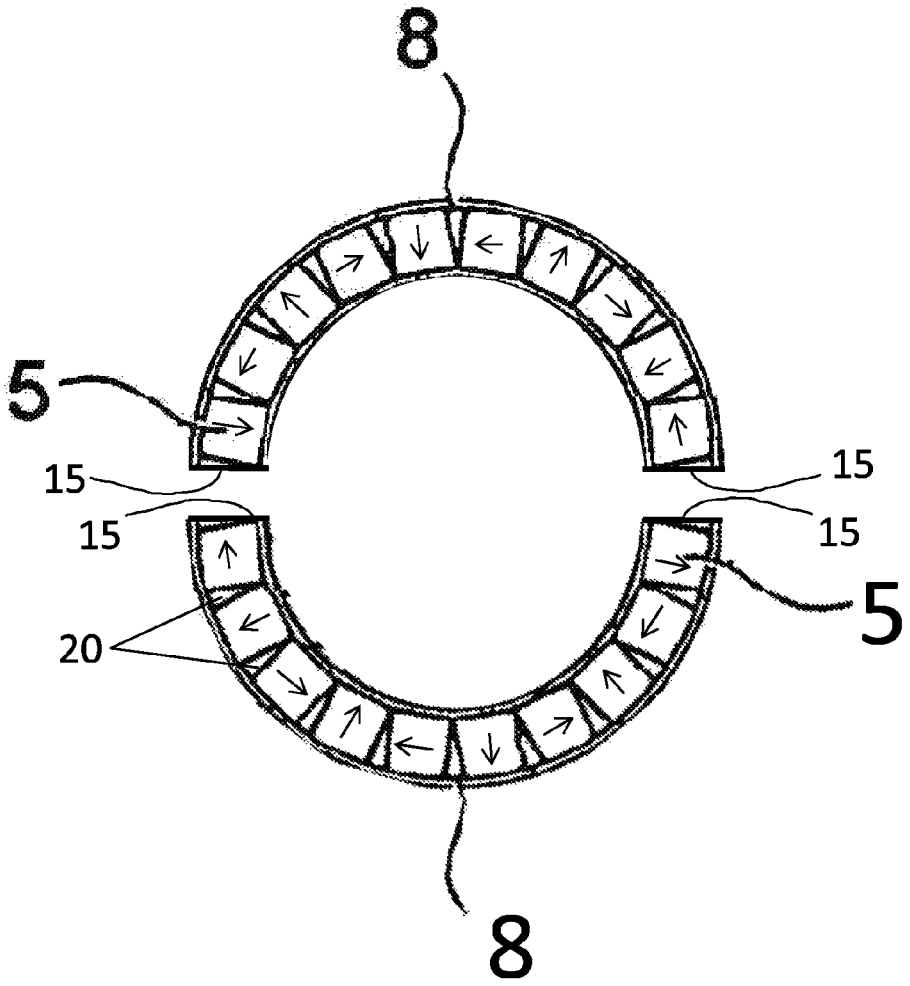
*Fig.* 5

DOWNHOLE TOOL AND METHOD

FIELD OF THE INVENTION

The present invention relates to a cleaning tool for use in removing metallic debris from a wellbore.

BACKGROUND TO THE INVENTION

In the oil and gas exploration and production industry, a wellbore or borehole of an oil or gas well is typically drilled from surface to a first depth and lined with a steel casing which is cemented in place. The borehole is then extended and a further section of tubing known as a liner is located in the borehole, extending from the casing to a producing formation, and is also cemented in place. The well is then completed by locating a string of production tubing within the casing/liner, through which well fluids flow to surface.

However, before the well can be completed, it is necessary to clean the lined wellbore and replace the fluids present in the wellbore with a completion fluid such as brine. The cleaning process serves to remove solids adhered to the wall of the casing or liner, typically by use of scraping and brushing tools; to circulate residual drilling mud and other fluids out of the wellbore; and to filter out solids present in the wellbore fluid. A considerable amount of loose debris accumulates in the wellbore and on the surface of the casing/liner which debris comprises rust particles and metal shavings, cuttings or scrapings originating from equipment used in the well and the casing or liner itself. Whereas some of the debris can be removed during the normal circulation of fluid through the work string or drill string, a significant amount remains, and this is problematic because it may interfere with use of tools and instruments in the wellbore, and consequently efforts have to be made to remove such residual debris.

In an effort to address the metallic debris issues, magnetic well cleaning apparatus has been developed, such as that disclosed in the Applicant's UK Patent Number 2,350,632, which tool includes a number of magnets located under a protective sleeve. Another magnetic fishing tool is described in U.S. Pat. No. 6,591,117, wherein, large bar magnets are spaced apart around and along a tool body for the purposes of attracting and retrieving metal debris. These magnets may be permanent magnets made of any suitable magnetic material, including rare earth magnets such as neodymium iron boron, ceramic ferrite, samarium cobalt, or aluminium nickel cobalt. The bar magnets are fitted into recesses in the tool body and arranged to have an area between each magnet for metallic debris to settle. A further such tool is described in U.S. Pat. No. 6,354,386, wherein arcuate magnet assemblies are detachably secured by screws or other similar means to a body to be mounted in a drill string. An alternative fastening arrangement described there for the magnet assemblies uses split retainer rings provided with locking members for securing the magnets on the body.

In use of such fishing tools, ferrous metallic particles and debris present in the wellbore is attracted to the magnets and carried out of the wellbore when the cleaning tool is removed or "tripped" from the well.

An object of the invention is to provide further improvements in tool assembly and design.

SUMMARY OF THE INVENTION

According to a first aspect of the present invention, there is provided a method for removing debris from a wellbore comprising introducing a workstring body having an Halbach array of permanent magnets mounted thereon, moving the array through the wellbore using the workstring to bring the array into proximity with metallic debris to allow at least a proportion of such material to be collected upon a surface of the workstring by magnetic attraction from the Halbach array, and removing such material by recovering the workstring from the wellbore.

According to a further aspect of the present invention, there is provided a downhole tool comprising a tool body adapted for connection to a workstring, said tool body having an Halbach array of permanent magnets mounted thereon and configured to project an effective magnetic field from an exterior surface of the tool such that in use the tool can be used to collect debris from a wellbore.

The tool may comprise a cylindrical body and the magnets may be arranged in an Halbach cylinder configuration around the body, wherein the component magnets are arranged such that the effective magnetic field is entirely outside the cylinder, with substantially zero field inside.

Optionally, the tool surface includes a protective stainless steel shield over the magnets to protect them from breakage and corrosion. In a preferred embodiment the magnets are additionally encased within an inner sleeve which may be of stainless steel, and sealed in the tool e.g. by welding seams closed. A plurality of over-lapping or concentric shields may be provided to protect the magnets.

The manner of protecting the magnets may be as described in our patents GB 2 350 632 and U.S. Pat. No. 6,655,462, the content of which is incorporated herein by reference. In these patents a magnetic tool is described in which, a plurality of magnets are mounted in a tool body on a split sleeve, and an outer protective sleeve is located over same between non-rotating spiral stabilisers, the protective sleeve being rotatable relative to the stabilisers but restrained against axial displacement between the stabilisers.

The magnets may be made of any suitable magnetic material, such as rare earth magnetic materials, optionally associated with flux carrying materials.

Suitable magnetic materials include neodymium iron boron, ceramic ferrite, samarium cobalt, or aluminium nickel cobalt, and the like.

It is known that in an arrangement of two magnets having respective opposite poles facing each other (i.e., north to south), the magnets are attracted to each other, whereas like magnetic poles repulse each other. When magnets are oriented to repulse each other the magnetic field of each magnet is deflected by the neighbouring magnet. This phenomenon is commonly referred to as "bucking." The technical effect of this phenomenon is that magnetic fluxes are oriented in the same direction between the neighbouring magnets and the summation of the magnetic fluxes gives rise to a magnetic field that projects further outward from between the two magnets. This results in a magnetic field with greater "outward reach" than the magnetic field of a single magnet with the same strength.

It has now been found that a more efficient downhole debris recovery tool can be obtained by mounting permanent magnets in an Halbach array. This allows increased debris collection capacity and more efficient use of magnetic material.

The cylindrical Halbach array gives an intensified magnetic field on the outside of the tool which better enables it to capture and retain ferromagnetic debris in a wellbore.

Furthermore, it is possible to design a tool with a more compact debris collection area, which offers the opportunity to provide a more compact length of tool overall.

The arrangement also decreases the field strength in the interior of the magnet assembly which can offer operational advantages when operating the tool with other devices within the workstring which may be susceptible to magnetic interference or influence.

A further advantage of the tool of this invention lies in the fact that it will not accumulate debris on the inner bore of the tool where there is no effective magnetic field to attract such debris which could cause an obstruction to the passage of drop balls, wireline tools etc. to be passed through the workstring containing the tool for reasons understood in the art.

A tool made in accordance with the invention, may be made with a mandrel of greater cross-sectional area (improved strength) due to the ability to use a thinner magnet housing, thereby maintaining or improving magnetic field effect with improved structural properties.

According to a further aspect of the invention, there is provided a method of assembling a downhole debris recovery tool comprising providing an elongate body having an axial throughbore and pin and box end configurations for assembly of the tool into a workstring, the elongate body further having a recessed surface for receipt of magnetic elements, providing a plurality of semi-cylindrical parts each having an array of magnetic elements configured to form an Halbach array when the semi cylindrical parts are formed together into a cylinder, presenting the semi-cylindrical parts to the elongate body and arranging said parts in the recessed surface to form an Halbach array of cylindrical form, providing a close-fitting cylindrical sleeve and sliding same over the Halbach array and securing same to the elongate body.

The semi-cylindrical parts may be half cylinder sections each containing an even number of magnetic elements, say 8 or 10 covering 180 degrees, i.e. half of the intended Halbach cylindrical array. These parts may be individually sealed. The sleeve may be of a non-magnetic material, say of a stainless steel, and close fitting over the semi-cylindrical parts to hold same in position upon the elongate body and provide protection to the parts containing the magnetic elements in normal use of the tool.

The sleeve may be positioned over the magnetic elements between non-rotating stabilisers mounted on the tool, and restrained thereby with respect to axial displacement, but remaining freely rotatable with respect to the stabilisers.

It will be understood that references herein to "debris" is to material that includes ferrous material that is susceptible to attraction by a magnet and will include materials containing iron such as metal cuttings, shavings, chips, dislodged rust or the like which are found downhole, such as may be produced during downhole procedures. Such materials may, for example, be produced during drilling or milling of a window in a casing or liner, or may be dislodged during a cleaning operation. Thus the debris will not be entirely of a ferrous metal but will contain same together with contaminants such as mud and rock particles attached to cuttings or shavings from liner/casing tubulars etc.

It will also be understood that the tool serves for cleaning ferrous material from a wellbore in that the magnet generates a magnetic field which attracts ferrous material present in the wellbore towards the tool. Thus by translating the tool relative to the wellbore, the magnet may cause ferrous materials in the wellbore to become attracted towards and thus adhered to the tool, thereby facilitating removal of the ferrous material from the wellbore. Upon pulling the tool out of the wellbore and recovering the tool to surface, the debris can be cleaned of the surface and the tool is ready for re-use.

DESCRIPTION OF THE DRAWINGS

Embodiments of the present invention will now be described, by way of example only, with reference to the accompanying drawings, in which:

FIG. 5 is an exploded view of semi-cylindrical parts of a cleaning tool of the type shown in FIG. 2 with an arrangement of 10 abutting arcuate bar magnets.

MODES FOR PERFORMANCE OF THE INVENTION

Figure 1:
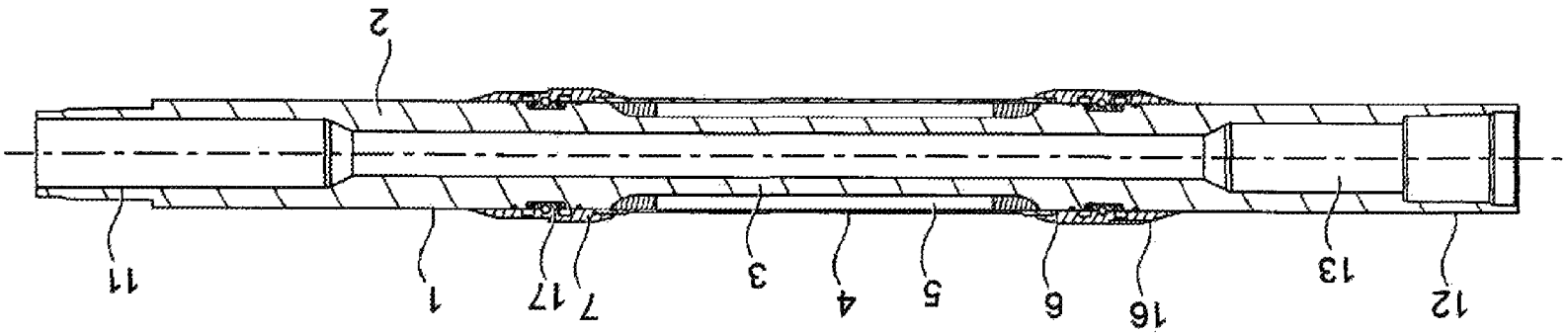
FIG. 1 is a longitudinal half-sectional view of an embodiment of a magnetic debris recovery tool of this invention.

Referring to FIG. 1, there is shown a longitudinal half-sectional view of a cleaning tool for use in cleaning ferrous material from a wellbore (not shown).

The tool which is indicated generally by reference numeral 1 is provided with pin 11 and box 12 sections as is conventional in the art to enable the tool to be removably incorporated in a work string (not shown). An axial throughbore 13 runs through the tool for circulation of fluid and passage of wireline tools and the like as commonly used in the art. An upper stabiliser 16 and lower stabiliser 17 are mounted on the tool and these are typically of the non-rotating type allowing the tool to rotate through and relative to the stabilisers as is understood in the art.

The tool comprises a tool body 2, provided with recessed section 3, the recessed section being formed from a reduced body diameter within the length between the pin and box sections 11, 12. A cylindrical shield 4 of greater length than the length of the recessed section 3 overlies the recessed section to define an annular chamber within which a selected number of bar magnets 5 are positioned. The bar magnets 5 are juxtaposed in parallel in an Halbach array to project a magnetic field radially outwards from the body of the tool 2.

The cylindrical shield 4 is positioned between the stabilisers 16, 17 and restrained thereby with respect to axial displacement, in that the stabilisers 16, 17, in part overlie the respective ends of the shield 4 which are positioned within respective annular recesses 6, 7 allowing the shield 4 to freely rotate with respect to the stabilisers 16, 17.

Figure 2:
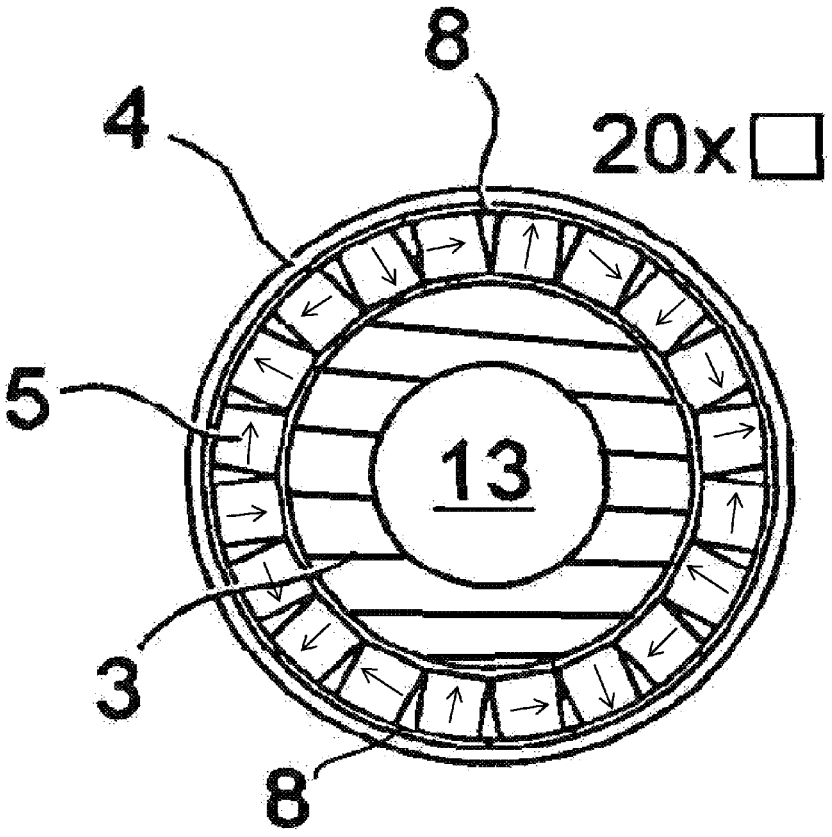
FIG. 2 is a sectional view taken along a line AA of a cleaning tool of the type shown in FIG. 1 with an arrangement of 20 square section bar magnets within a cylindrical shield.
Figure 3:
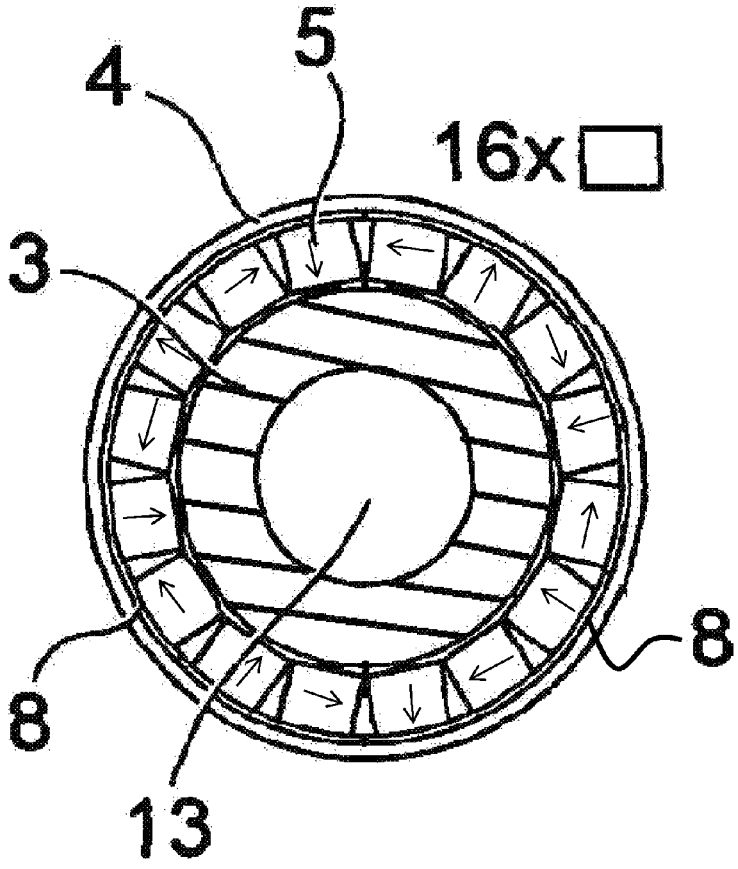
FIG. 3 is a sectional view taken along the line A-A of a cleaning tool of the type shown in FIG. 1 with an arrangement of 16 rectangular section bar magnets within a cylindrical shield.
Figure 4:
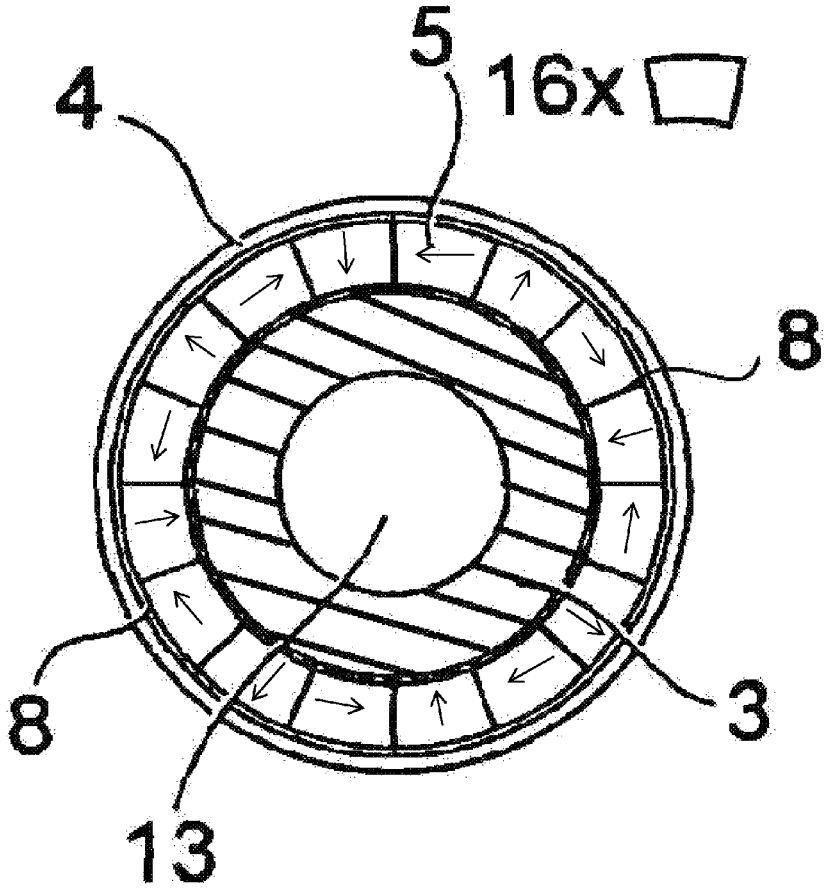
FIG. 4 is a sectional view taken along the line A-A of a cleaning tool of the type shown in FIG. 1 with an arrangement of 16 abutting arcuate bar magnets within a cylindrical shield.

The bar magnets 5 may be provided as square section, rectangular section or arcuate section, as shown respectively in FIGS. 2-4.

In assembly of the bar magnets into the desired Halbach array due consideration is given to the orientation of the juxtaposed magnets such that each magnet is magnetised in a different direction from the adjacent ones to develop a uniform field around the juxtaposed magnets with virtually no field within the centre of the cylindrical array. In the case of a square section magnet as in FIG. 2 the top face of one such magnet corresponds to a side face of the next adjacent magnet and so forth to "rotate" the field direction in turn. Generally 4×n magnets can be used to complete the assembly.

The same positioning principle applies to arcuate section magnets to form a close fitting cylindrical magnet assembly with an external magnetic field and substantially zero field in the internal core thereof.

After assembly of the magnets 5 in the recessed section 3, a stainless steel sleeve provides the shield 4 which is positioned over the recessed section to protect the magnets, and provide a seal over the recessed section with the tool body 2.

Optionally, a resin or inert filler can be used to fill void space 20 around the magnets 5, and thereby inhibit exposure of the magnets to atmosphere or contaminating particles which might promote corrosion in use.

In an embodiment of the invention, the tool is assembled by providing two semi-cylindrical half-parts 8 each having an array of 8 to 10 magnetic elements 5 covering 180 degrees and configured to form an Halbach array when the semi cylindrical parts are formed together into a cylinder, as shown in FIG. 5. The semi-cylindrical parts 8 are presented to the body 2 and arranged to seal in the recessed section to form an Halbach array of cylindrical form. A close-fitting cylindrical stainless steel sleeve 4 is slid over the assembled Halbach array thereby confining same within the recessed section of the elongate body. The sleeve 4 is secured to the body by provision of stabilisers 16, 17 which overlap the sleeve ends with sufficient clearance to allow the sleeve 4 to rotate relative thereto.

The respective semi-cylindrical parts 8 are sealed, for example by welding seams 15, for protection of the magnetic elements 5 during assembly, and during normal use in the field, and any subsequent re-dressing of the tool as may be required after use in the field.

In use of such a tool in a clean up operation to remove debris from the wellbore, a workstring incorporating the tool within its length is assembled and run in the hole. During run in the wellbore, the tool will attract susceptible material which will become picked up and carried upon the tool body surface due to the magnetic pull on the material. When it is considered that the tool has been passed through the target zones where debris has collected, the work string can be pulled out hole and the debris cleaned off the surface for re-use of the tool.

INDUSTRIAL APPLICABILITY

In a typical use of the cleaning tool, it is provided as part of a work string run into the wellbore and may, for example, form part of a drilling or milling string (not shown) which may for example include jetting, milling or other tool functions.

Various modifications may be made to the foregoing without departing from the scope of the present invention as defined by the claims.

The invention claimed is:

1. A downhole debris recovery tool comprising:

an elongate body having an axial throughbore and pin and box end configurations for assembly of the tool into a workstring, the elongate body further having a recessed surface for receipt of magnetic elements, and a pair of semi-cylindrical parts each having an array of uniformly sized magnetic elements configured to form an Halbach array when the semi cylindrical parts are formed together into a cylinder, wherein the semi-cylindrical parts are arranged in the recessed surface of the elongate body to form the Halbach array of cylindrical form, and a close-fitting cylindrical sleeve slidable over the cylinder having the Halbach array, the close-fitting cylindrical sleeve secured to the elongate body by provision of stabilizers which overlay respective ends of the sleeve with sufficient clearance in respective recesses so that the sleeve is restrained with respect to axial displacement between the stabilizers and freely rotatable with respect to the stabilizers.

2. The downhole debris recovery tool of claim 1, wherein the tool comprises a cylindrical body and the magnets are arranged in an Halbach cylinder configuration around the body, wherein the component magnets are arranged such that the effective magnetic field is entirely outside the cylinder, with substantially zero field inside.

3. The downhole debris recovery tool of claim 1, wherein the magnets are encased within stainless steel and sealed in the tool.

4. The downhole debris recovery tool of claim 1, wherein the magnets are made of rare earth magnetic materials, optionally associated with flux carrying materials.

5. The downhole debris recovery tool of claim 1, wherein the magnets comprise at least one of the group consisting of neodymium iron boron, ceramic ferrite, samarium cobalt, and aluminium nickel cobalt.

6. The downhole debris recovery tool claimed in claim 1, wherein the semi-cylindrical parts each contain an even number of magnetic elements covering 180 degrees.

7. The downhole debris recovery tool of claim 6, wherein the semi-cylindrical parts each comprise a plurality of void spaces around the magnets, wherein the void spaces are filled to inhibit corrosion.

8. The downhole debris recovery of claim 1, wherein the semi cylindrical parts are individually sealed for protection of the magnets.

9. The downhole debris recovery tool of claim 6, wherein there are 8 magnetic elements.

10. The downhole debris recovery tool of claim 6, wherein there are 10 magnetic elements.

* * * * *